US006390727B1

(12) United States Patent
Guntert, Jr. et al.

(10) Patent No.: US 6,390,727 B1
(45) Date of Patent: May 21, 2002

(54) DOWEL BAR INSERTER KIT HAVING CHAIN FEEDER

(75) Inventors: Ronald M. Guntert, Jr., Stockton; Gerald Lee Dahlinger, Ripon; Richard W. Francis, Stockton, all of CA (US)

(73) Assignee: Guntert & Zimmerman Const. Div., Inc., Ripon, CA (US)

( * ) Notice: Subject to any disclaimer, the term of this patent is extended or adjusted under 35 U.S.C. 154(b) by 0 days.

(21) Appl. No.: 09/586,468

(22) Filed: Jun. 1, 2000

Related U.S. Application Data

(63) Continuation-in-part of application No. 09/411,744, filed on Oct. 1, 1999.

(51) Int. Cl.[7] ..... E01C 23/02

(52) U.S. Cl. ..... 404/88; 404/96

(58) Field of Search ..... 404/87, 88, 89, 404/96, 105, 106, 75

(56) References Cited

U.S. PATENT DOCUMENTS

| | | | | |
|---|---|---|---|---|
| 4,493,584 A | | 1/1985 | Guntert | |
| 5,135,333 A | | 8/1992 | Guntert, Sr. et al. | |
| 5,190,397 A | | 3/1993 | Bengford et al. | |
| 5,209,602 A | | 5/1993 | Godbersen | |
| 5,318,377 A | * | 6/1994 | Swisher, Jr. et al. | 404/74 |
| 5,405,212 A | | 4/1995 | Swisher, Jr. et al. | |
| 5,588,776 A | * | 12/1996 | Swisher, Jr. et al. | 404/72 |
| 5,590,977 A | | 1/1997 | Guntert et al. | 404/101 |
| 5,615,972 A | | 4/1997 | Guntert et al. | |
| 5,647,688 A | | 7/1997 | Guntert et al. | |
| 5,924,817 A | | 7/1999 | Godbersen | |

OTHER PUBLICATIONS

RexCon Concrete Batch Plants and Controls, "Model S Batch Plant," www.rexcon.com/products/english/e batch/e models.html., Apr. 9, 1999, 2 pp. description, 2 pp. pictures.

Erie Strayer Co., MG–11C Central Mix Batching Plants, "Mobile Gravity 11 Central Mix," Bulletin No. MG11C89, Feb. 1989.

Erie Strayer Co., Sentry/Scout Batching Control System, "Fast, Accurate, Reliable Batching Control Systems," Bulletin No. CP, Mar. 1999.

Erie Strayer co., "Mobile Gravity and Central Mix Plant," Drawing No. 4A–219801, Jan. 7, 1991.

(List continued on next page.)

*Primary Examiner*—Gary S. Hartmann
(74) *Attorney, Agent, or Firm*—William Michael Hynes; Townsend and Townsend and Crew, LLP

(57) ABSTRACT

A dowel bar inserter kit is used, typically in combination with a paver. The dowel bar inserter kit is removably detachable from the paver and includes at least two laterally extending support beams supported from the paver extending away from and behind the paver over the formed plastic concrete slab. A plurality of support carriages move synchronously on each laterally extending support beam towards and away from the supported frame of the paver. A suspended dowel bar inserter pan is attached at distal ends to the support carriages, the suspended dowel bar inserter pan defines apertures for insertion of dowel bars through the suspended dowel bar inserter pan. The dowel bar inserter pan has a medial dowel bar insert pan hinge to enable the suspended dowel bar inserter pan to crown with respect to the freshly placed plastic concrete slab. An inserter beam is supported at distal ends to the support carriages. The inserter beam has dowel bar inserters corresponding to the apertures for the insertion of dowel bars through the suspended dowel bar inserter pan. The inserter beam has a medial inserter beam hinge to enable the suspended dowel bar inserter beam to crown with respect to a corresponding crown in the suspended dowel bar inserter pan.

14 Claims, 11 Drawing Sheets

OTHER PUBLICATIONS

Erie Strayer co., "Mobile Gravity, Central Mix Plant with Conc. Directional Chute," Drawing No. 4A–219802, Jan. 7, 1991.

Vince Hagan Co., "Super Haganator, 'Mobile Paver' Central Mix Concrete Plant System (2 to 12 cubic yards)," Bulletin 109, Nov. 15, 1977.

Vince Hagan Co., "10 Yard Central Mix Plant," Drawing No. S228, Apr. 20, 1982.

Heltzel Steel Form & Iron Co., "Self–Erect Mobile Central–Mix Batching Plants and Mobile Mixers," Bulletin No. 66–70R.

Johnson–Ross Concrete Plants, "Ranger 750," Bulletin No. 750–098.

* cited by examiner

LEFT TERMINAL
70
72
56
50
52
K
60
R
S
I
54
62
64
32
0

TOP OF STROKE
BEAM IS FLAT
BARS GO ACROSS
PAN IS MOVING

BEAM IS IN STAGED POSITION
BEAM IS FLAT
BARS ARE LOADED
PAN IS MOVING

HALF + STROKE
BEAM IS FLAT
CENTER BAR AT DEPTH
PAN IS FIXED

FULL STROKE
BEAM IS CROWNED
CENTER BAR AT DEPTH
PAN IS FIXED

DOWEL BAR INSERTER KIT HAVING CHAIN FEEDER

This is a Continuation-In-Part of U.S. patent application Ser. No. 09/411,744 filed Oct. 1, 1999 by the inventors herein. In this Application, we set forth the novel suspension and cycle of the dowel bar inserters utilized with this mechanism, especially in so far as they relate to slabs with a "crown" or "roof shape."

BACKGROUND OF THE INVENTION

Concrete slipform pavers are known. Specifically, such pavers include a "tractor" and a "paving kit".

Regarding the tractor, most concrete slipform pavers include a tractor, which is comprised of a rectilinear frame. This rectilinear frame has bolsters extending parallel to the direction of machine travel and cross beams extending across the paved roadway or runway. The rectilinear frame thus straddles the paved concrete path while it is paved. This frame is propelled and supported on either end by side crawler track(s). The frame supports a diesel engine driven hydraulic power unit, which supplies power to the tractor and paving kit.

The paving kit is typically suspended below the rectilinear tractor frame by mechanical means. The paving kit takes its hydraulic power from the power unit on the tractor. The tractor and paving kit comprise the slipform. This slipform passes over concrete placed in its path. The concrete is placed in a relatively even and level mass that can be either flat, super elevated (as at curves in the roadway) or crowned. During this slipform process the tractor attached paving kit spreads the concrete dumped in the path of the paver, levels and vibrates it into a semi-liquid state, then confines and finishes the concrete into a slab with an upwardly exposed and finished surface. Sideforms mounted to the side of the slipform kit confine the sides of the slab during the paving process.

The tractor typically has either two or four crawler tracks supporting and propelling the frame and attached paving kit. Other kits can be attached to these tractors such as kits for conveying and spreading concrete and trimming and spreading base materials. For the purposes of this description, we will focus on the paving kit working in conjunction with a rear mounted, dowel bar inserter kit used for slipforming a concrete slab and concurrently inserting dowel bars in the plastic concrete across the slipform paved slab.

Dowel bars, tie bars and inserters for dowel bars and tie bars on such paving machines are known. In general, dowel bars are placed parallel to the direction of machine travel and ties bars are placed across the direction of machine travel. Specifically, three types of inserters for such bars are known. First, there is the tie bar inserter for the edge of the slab. This tie bar is placed transverse to the paving direction and enables tying of sequentially placed side-by-side slabs, one to another. This type of tie bar and tie bar inserter is not of concern here.

Second, there is the tie bar inserter for placing tie bars completely within the placed slab. A placed slab might be a two or more 12' (3.657 mm) wide lane being placed concurrently in one pass. These tie bars are placed in a line transverse to the direction of machine travel. These tie bars enable a joint to be subsequently cut in the middle of the slab parallel to the direction of machine travel. Expansion of the slab across the dimension of machine travel is not permitted, the two slabs are tied. This type of tie bar and dowel bar inserter is not of concern here.

Finally, and the most difficult insertion problem is the dowel bar inserter for placing dowel bars parallel to the direction of machine travel. The dowel bars are simultaneously placed in a line (or row) on what are typically 12" (305 mm) centers, across the entire slab being slipformed by the paver. These dowel bars enable a joint to be subsequently cut in the slab across the direction of machine travel. The dowels provide load transfer between the adjoining panels in the direction of machine travel. The smooth dowels also allow the adjoining panels to move while the slab surfaces are kept on the same plane.

This type of dowel bar inserter presents the most difficult insertion problem in any slipform paver. Additionally, this type of dowel bar inserter requires modification to be made to the slipform paver to attach the dowel bar inserter. In addition to this, great effort is required to attach or remove the dowel bar inserter from the slipform paver. It might take an additional two days to assemble a machine with a dowel bar inserter. This great effort has limited the dowel bar inserters acceptance on smaller paving jobs. In what follows, we first discuss the most modern pavers, which have been developed. Second, we turn to the prior art problem of dowel bar insertion. Third, we set forth the mechanical problem of attachment and removal of dowel bar inserters to known pavers, including the pavers summarized above.

In Guntert et al U.S. Pat. No. 5,590,977 issued Jan. 7, 1997, entitled Four Track Paving Machine and Process of Transport we have disclosed a portable slip form paver that used telescoping members in the direction of machine travel. A four-track paver is disclosed having a frame, which telescopes for transport to reduce the dimension of the machine in the direction of paving machine travel. A rectilinear tractor frame is provided. The frame includes four crawler tracks, one connected to each corner of the frame via a side bolster. The crawler tracks are directly supported on a hydraulic cylinder and mounted for pivotal movement about the vertical axis of the hydraulic cylinder. The frame telescopes at side bolsters between the leading and trailing crawler tracks at the sides of the machine. When expanded, the paving machine has the full dimension required for paving. When contracted, the paving machine has a profile allowing convenient transport. Most importantly, such expansion and contraction of the machine in the direction of paving travel does not require substantial paver or paver kit disassembly. As a consequence, a convenient method of loading and off loading to a hauling flatbed trailer exists. With the frame contracted at the side bolsters and the tracks pivoted parallel to the pavement spanning dimension of the frame, both frame and paving kit are elevated and a transporting flatbed trailer moved under the paver. Supports are installed to relieve the slipform paving kit from the full weight of the tractor frame, and the tracks lifted. There results a four track paver profile transportable within a maximum width envelope which can be legally transported on the highway without a pilot car (in the U.S.A. this is this is 12' or (3.657M.) This patent is incorporated by reference to this disclosure as if set forth in full.

In Guntert et al U.S. Pat. No. 5,615,972 issued Apr. 1, 1997 entitled Paving Machine with Extended Telescoping Members (see also U.S. Pat. No. 5,647,688) we have disclosed a portable slip form paver having an extendable width. A conventional telescoping frame on a paving tractor is provided with fixed frame cross beam extension members for insertion to and attachment with a telescoping frame member. The conventional telescoping frame includes paired forward and paired rear side-by-side female tube members. Each forward and rear tube member conventionally acts for the telescoping support of male extension members which attach directly to the side bolster, which in turn attaches to the hydraulic jacking columns and crawlers. Within the limits of expansion, the male extension members co-acting with clamps acting through the female tube members provide for both movement of the point of crawler support and expansion of the paving width of the tractor frame. Into this combination, extenders are added for attachment to the supported end of the male extension members interior of the female telescoping members. During frame width expansion, the male telescoping members are expanded to register their ends interior of the female telescoping members to attachment access ports in the female telescoping member. The extenders are inserted, supported, and registered at complimentary attachment apertures with attachment to the male telescoping members taking place. Once attachment has occurred, further extension of the male telescoping members occurs. A simple system of pinned cross bracing reinforces the extended frame with relatively light bracing members. When the telescoping members at both sides of the frame are provided with the extenders to extend the telescoping span of the paver, a tractor of greater expansion and range of expansion capability is provided. This width expansion obviates the need for fixed frame extensions, and permits frame expansion without heavy lifting equipment. This patent is incorporated by reference to this disclosure as if set forth in full.

Machines built to the specification of the above referenced patents require dowel bar inserters from time to time. Regarding such dowel bar insertion, the dowel bars must be placed parallel to the direction of machine travel. A line of dowel bars must be simultaneously inserted across the slab being formed. Typically, 12 to 34 or more such dowel bars can be inserted depending upon the width of pavement being paved. Center to center spacing of insertion between the dowel bars can vary. Variation can occur from about 12 inches (305 mm) on typical highway paving up to 18 inches (457 mm) for certain airport runways, aprons and taxiways. All such dowel bars must be inserted simultaneously by a mechanism, which remains stationary with respect to the plastic concrete slab being continuously formed. Thus, the dowel bar inserter must be on rails, which permit dowel bar inserter travel in the direction of concrete placement by the machine.

In U.S. patent application Ser. No. 09/411,744 filed Oct. 1, 1999 entitled Detachable Dowel Bar Inserter Kit for Portable SlipForm by the inventors herein we set forth a dowel bar inserter kit which attaches as unit to the rear of a paver. In a companion U.S. patent application Ser. No. 09/411744 filed Oct. 1, 1999 entitled Dowel Bar Inserter Kit Having Chain Feeder by the inventors herein, we stress the chain feeder used here in the preferred embodiment. In this Application, we address the unique paver kit configuration required by a so-called "crowned slab."

Placement of dowel bar inserters on existing pavers has also caused difficulty. To place such inserters on a conventional paver, substantial machine disassembly and modification must occur. First, the trailing finishing pan must be removed. Second, the conventional bolsters must be modified and extensions added to allow room in front of the rear crawler track to make room for the dowel bar inserter to work. These bolster extensions also support the dowel bar inserter kit. Third, because the rear crawler tracks have been moved back, a cross-beam must be added between the rear bolsters to prevent the extended bolsters from twisting under load. Fourth, an optional spreader plow for the correcting beam must be added. Fifth, an oscillating correcting beam—the beam that establishes the final slab grade from the paver, after the dowel bar inserter inserts the bars—must be added. Thereafter, the trailing finishing pan is reattached behind the correcting beam. To fit these required pieces of the dowel bar inserter between the rear of the slipform conforming pan and ahead of the rear crawler track can increase the center to center distance between the front and rear crawler tracks by as much as 20' (6.10M). The dowel bar inserter and its related attachments also necessitates two additional trucks to haul it.

This process of attachment of dowel bar inserters is sufficiently complex, that for relatively small paving jobs, dowel bar inserters are not used because of the high mobilization cost. Instead, such dowel bars are tied together and support on "baskets" or "chairs" and secured to the subgrade ahead of the slipform. The baskets hold the dowels in position at the center of the slab. In order to deliver concrete in front of the slipform paver, an additional machine(s) (concrete placer spreader(s)) must be employed to receive concrete from the side of the pavement then dump and spread it in front of the paver. These dowel baskets assemblies are significantly more expensive than loose dowels and require additional machinery to deliver the concrete across the front of the slipform and significant labor to install However, the extra mobilization and transport cost of a paver with a dowel bar inserter outweighs this extra cost on a small job.

We have largely solved the above problems with the disclosures referenced above. However, there remains the problem of the so-called "crowned slab."

DISCOVERY OF THE PROBLEM TO BE SOLVED

It is common to build a "crown" in continuously placed slabs. The "crown" is the elevated center surface of a slab (sometimes referred to a "roof top" profile) which enables water falling on the central portion of the slab to run to the either side of the slab. This theoretically enhances drainage. Unfortunately, where slabs have such "crowns", this complicates the placement of dowel bars using automatic dowel bar inserters mounted of the back and behind the paving kit of the slipform paver.

Regarding such a complication, automatic dowel bar inserters have their slab confining pans configured with closely spaced apertures formed between two lane spacer pans, through which dowel bars are inserted. Typically, the dowel bars are first distributed across the confining pan. Just prior to insertion the dowel bars are dropped on the recently slipformed slab at the apertures. At this point the dowels are vibrated into the slab by vibrating inserters in combination with light hydraulic pressure - with two sets of such inserter forks pushing each dowel bar into place with respect to the pan. If the inserter forks are at an angle during dowel bar insertion or not properly centered on the apertures, it is possible for the inserter forks to come into contact and interfere with the sides of the dowel bar lane spacer pans (dowel bar insertion apertures).

At the same time, uniformity of dowel bar placement with respect to the concrete slab surface is desired. It is preferred that each dowel bar be placed at a uniform depth with respect to the top surface of the slab. If the dowel bars are placed at varying depths in the slab, this placement can fall outside of the job specifications. Uniform dowel depth is important for the reasons that uniform load transfer between discrete slabs across expansion joints may not occur.

Another problem with dowel bar insertion is displacement of the plastic slab from the shape of the slipformed as it leaves the paver. Assuming that dowel bars are vibrated and inserted into a slab, the fluidized the concrete around the placed dowel bar. And when the concrete is fluidized and the mass of an additional dowel bar added to the slab, concrete becomes displaced. The displaced concrete mass must subsequently be "refinished" to form an acceptable pavement surface.

In our preferred method of placing dowel bars, we place such bars through dowel bar apertures (defined between the dowel bar lane spacer pans) in a dowel bar inserter pan. It will be understood that the dowel bar inserter pan typically floats on the newly placed concrete. When a dowel bar is inserted through dowel bar apertures in a dowel bar inserter pan, slab displacement due to dowel bar insertion is confined and minimized.

The use of dowel bar inserters in combination with a dowel bar insertion pan having dowel bar insertion apertures presents another difficulty. It is necessary to keep the inserter support beam, on which the inserter fork assemblies are mounted centered in respect to the dowel bar inserter pan apertures. Such centering must occur without adversely affecting the pressure or load on the dowel bar inserter pan that floats on the plastic concrete.

In what follows, it will be seen that we have designed a dowel bar inserter kit. This dowel bar inserter kit enables dowel bars to be placed to a "crowned" slab through a dowel bar inserter pan which in effects "floats" on the surface of the concrete. Inserting occurs through apertures in the dowel bar insertion pan while the pan confines at least some of the resultant expansion of the concrete due to the insertion of the dowel bars. Most importantly, the insertion of the dowel bars does not appreciably change the buoyant forces on the dowel bar inserter pan. As will be seen, this seemingly simple problem has a complex solution.

SUMMARY OF THE INVENTION

A paver is provided with a removable dowel bar inserter kit adapted for the placement of dowel bars in a slab provided with or without a crown. The paver has a propelling apparatus for moving along a paving path. A frame is supported from the propelling apparatus and includes paver bolsters extending parallel to the paving path and cross beams extending across the paving path. The suspended slipform paving kit is attached to the paver frame for receiving concrete placed on the paving path and slipforming the plastic concrete into a continuous slab on the paving path. The paving kit as suspended from the paver gives the slab its shape. This shape can be flat or crowned. When, the slab is paved with a crown, the problem solved by this invention arises.

In our improved embodiment, a dowel bar inserter kit attaches to the paver frame at four flanges. This dowel bar inserter kit has a dowel bar inserter pan defining dowel bar inserter apertures. Additionally, this dowel bar inserter kit includes dowel bar inserter assemblies. These inserters have forks which extend through the dowel bar insertion apertures in the dowel bar insertion pan. Simply stated, dowel bars are placed on the recently formed plastic slab through the dowel bar insertion apertures. As known in the prior art, the dowel bar inserters push the placed dowel bars and vibrate the placed dowel bars. As pushed and vibrated, the dowel bars are imbedded into the slab. This disclosure is directed to enabling this process to occur when a slab is crowned.

When the paver kit is attached to the paver, two lateral supportbeams extending away from the paver frame in the direction of machine travel. The two carriages are on opposite sides of the dowel bar inserter kit, and ride on the lateral support beams, with one carriage on each beam. The movement of the carriages on the lateral support beams occurs synchronously on both sides of the paving kit. The carriages travel on the beams but remain stationary with respect to the recently placed plastic slab during dowel bar insertion. The two carriages simultaneously retract to the paver frame on the lateral supporting beams at the conclusion of each dowel bar insertion cycle.

The carriages together provide four discrete functions. First, the carriages vertically support a dowel bar inserter pan to the paver through telescoping tubes and hand winches so that the buoyant force of the dowel bar inserter pan together with its alignment to and suspension from the paver can be adjustably maintained. Second, the carriages adjustably suspend an inserter beam with respect to the paver to allow a plurality of dowel bar inserter fork assemblies suspended from the support beam to place dowel bars into a continuous slab without changing force on the buoyantly supported dowel bar inserter pan. Third, the carriages provide vertical members with respect to the frame of the paver which enable side to side, fore and aft, and vertical reference of the support beam with respect to the paver frame during its required up and down inserting movement. Fourth, the carriages enable side to side, and fore and aft centering of the dowel bar inserter pan at their edges adjacent the carriages.

The suspended dowel bar inserter pan is required to crown corresponding to any crown placed in the continuous slab by the paving kit of the paver. Remembering that the dowel bar inserter pan is supported from the carriages on either side of the paver, hydraulic crowning cylinders are provided in the center of the dowel bar inserter pan. These cylinders expand to crown the dowel bar inserter pan responsive to a sensor taking reference from the corresponding crown on the paving kit of the paver. Thus the dowel bar inserter pan can be crowned to match the slab crown without requiring support from the central portion of the paver.

It is required that the insertion beam for the dowel bar inserters be centered with respect to the dowel bar insertion pan. When the insertion beam is horizontal and centered, the insertion forks for the dowel bars avoid interference with the narrow openings in the dowel bar inserter pan through which the dowel bars are introduced to the slab. However, the insertion beam must "crown" in conformance with the corresponding "crown" on the dowel bar inserter pan at the end of the dowel bar insertion cycle. Accordingly, central vertical telescoping tubes extend between the insertion beam at an upper end and a pin to the dowel bar inserter pan at a lower end to maintain centering and to permit insertion of all dowel bars to their specified depth. These central telescoping tubes must be maintained vertical.

The central telescoping tube attached to the insertion beam is provided with a dynamic "A-frame" linkage to maintain verticality with respect to the frame of the paver. This central telescoping tube attached to the insertion beam imparts centering to the complimentary central telescoping beam attached to the central "crowning" portion of the dowel bar inserter pan.

Regarding the central telescoping beam attached to the insertion beam, two links attach to the insertion beam equidistant from a central insertion beam hinge. The central insertion beam hinge permits insertion beam crowning; these links form the sides of the dynamic "A-frame." The links are pinned at top of the dynamic "A-frame" to the top of the telescoping tube from the insertion beam to provide a first vertical reference point to the telescoping beam. A second vertical reference point is supplied to the central telescoping beam attached to the insertion beam by rollers attached to the insertion beam. Thus, even when the insertion beam crowns as it moves with respect to the dowel bar inserter pan, a vertical telescoping tube extending from the insertion beam is provided with a vertical reference with respect to the paver.

Secondly, a complimentary central telescoping tube is pinned centrally of the dowel bar inserter pan at its lower end. This complimentary central telescoping tube is received through a roller arrangement in sliding engagement with the upper central telescoping tube from the insertion beam. Consequently, as the insertion beam moves towards and away from the dowel bar inserter pan, the insertion beam is centered with respect to the dowel bar inserter pan. Likewise, and because of the roller arrangement, such movement occurs without appreciably changing the loading on the dowel bar inserter pan.

When it is necessary to crown the dowel bar inserter pan, the insertion beam and suspended the dowel bar inserter assemblies are disposed in a horizontal disposition overlying the crowned dowel bar inserter pan. This enables the dowel bar inserter assemblies to precisely penetrate the apertures for insertion of dowel bars through the dowel bar inserter pan openings, as the dowel bar inserter both floats and is supported at its ends with respect to the recently formed and plastic concrete slab.

Because the pan is crowned and insertion beam is disposed horizontally during the initial dowel bar insertion process, the first inserter fork on either side of the crown will reach their final insertion depth first. This will not be true for the inserters at either extreme end of the dowel bar inserter beam. These inserters will only partially penetrate to their full depth.

When the dowel bar inserter beam effectively reaches full penetration of the inserters that are central to the dowel bar inserter pan, the dowel bar inserter beam is crowned by hydraulic cylinders to match the crown of the dowel bar inserter pan. This causes the inserters at each extreme end of the insertion beam to register to the dowel bar inserter apertures on the dowel bar inserter pan. At the same time, the insertion beam remains centered with respect to the dowel bar inserter pan. Full penetration of the dowel bars across the "crowned slab" is assured.

In removal of the dowel bar inserters, the sequence is reversed. The dowel bar inserter beam is first moved to the horizontal disposition. It is thereafter retracted so that the individual inserter forks clear the dowel bar insertion apertures in the dowel bar insertion pan. Thereafter, the dowel bar inserter pan is retracted to the paver in the direction of paver movement with the supporting carriages moving on the lateral support beam. Repeating of the cycle occurs until paving is completed.

BRIEF DESCRIPTION OF THE DRAWINGS

FIG. 5A illustrates the fully retracted dowel bar inserters suspended from a horizontal dowel bar inserter beam with dowel bars placed on the slab through dowel bar insertion apertures in the dowel bar insertion pan;

FIG. 5B illustrates the beginning penetration of the dowel bar inserters through the dowel bar insertion apertures of the dowel bar insertion pan with the central dowel bar inserters making dowel bar insertion aperture penetration and the side dowel bar inserters out of registration with their respective dowel bar insertion apertures;

FIG. 5C illustrates the central dowel bar inserters fully penetrated through the dowel bar insertion apertures of the dowel bar insertion pan but the side dowel bar inserters not fully penetrating their respective dowel bar insertion apertures because the dowel bar insertion beam is yet to crown;

FIG. 5D illustrates the fully crowned dowel bar insertion beam enabling full and uniform penetration of the dowel bar inserters at all apertures across the dowel bar insertion pan, this figure showing schematically the elevation and steering reference wire on one side of the machine; and, FIG. 6 is schematic of a sensor system for crowning of the dowel bar inserter pan with respect to the main slip form under the paver.

DESCRIPTION OF THE SPECIFIC EMBODIMENTS

Figure 1A:
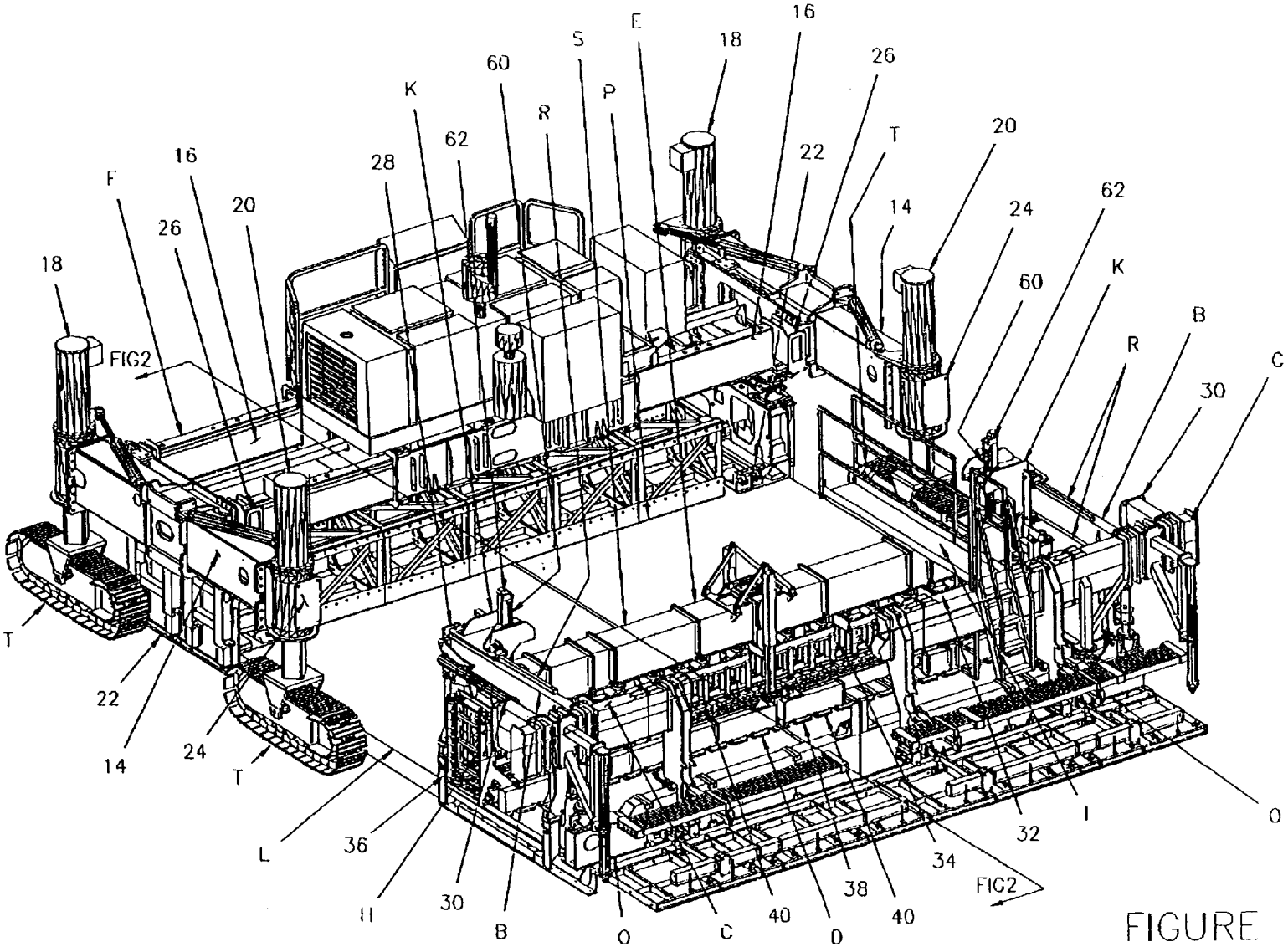
FIG. 1A is a perspective view of a slipform paver in accordance with Guntert et al U.S. Pat. Nos. 5,590,977 and 5,615,972 showing the slipform paver in exploded relationship with respect to the dowel bar inserter kit of this invention.

Referring to FIG. 1A, paver P and dowel bar inserter kit E are shown in exploded relationship. As the full description of the paver is set forth in the referenced patents, only a summary description of paver P will here be provided.

Paver P includes paver bolsters 14, paver cross beams 16, front jacking columns 18 and rear jacking columns 20. Together, paver bolsters 14, paver cross beams 16, front jacking columns 18, and rear jacking columns 20 constitute paver frame F.

Paver P suspends slip form paving kit 22 from paver frame F. Finally, paver P must be propelled. Such propulsion comes from four crawler tracks T. The reader will understand that many pavers P only have two crawler tracks. Further, it will be understood that the example of crawler tracks T is exemplary only. All kinds of devices are utilized to propel pavers including tires, rails, cables, sleds and the like. The propulsion referred to in this specification is considered to be generic.

Dowel bar inserter kit E is the novel subject matter of this invention. Dowel bar inserter kit E includes side bolsters or support beams S and at least one crossbeam C. These members form a rigid construction enabling the dowel bar inserter kit E to be handled in a unitary manner. The reader will observe that crossbeam C has been broken away in the view of FIG. 1 to enable important working portions of dowel bar inserter kit E to be seen. However that may be, it is important to understand that crossbeam C is unitary, solid member which performs structural reinforcement function when dowel bar inserter kit E is attached to paver P and ties the dowel bar inserter kit E together when it is separated from paver P.

Front jacking columns 18 and rear jacking columns 20 level paver frame F with respect to a level reference system which is here not shown or discussed. What is important to understand is that paver frame F is maintained level in a disposition for paving and that dowel bar inserter kit E must have that same level disposition in order to function properly. Accordingly, attachment of side bolsters or support beams S to paver frame F and rear cross beam C to jacking columns 20 will now be set forth.

Paver P requires the addition of four mounting flanges to enable side bolsters or support beams S to be attached to paver frame F. Rear jacking column flanges 24 and rear paver cross beam flanges 26 are provided to paver P. Similarly, front side bolster B flange 28 and cross beam C flange 30 are provided to dowel bar inserter kit E. It will thus be seen that each side bolster B is rigidly affixed to paver frame F of paver P and maintains the same disposition of paver P when the required attachment occurs.

It will be realized that in FIG. 1A we do not actually show the required physical attachment; the exploded view is provided for the convenience of the reader so that the kit may readily be distinguished from the paver. It will be understood that during attachment of dowel bar inserter kit E to paver P, hydraulic and electric power is most conveniently provided from paver P to dowel bar inserter kit E. It will therefore be understood that medially of paver P and medially of dowel bar inserter kit E there are respective electrical and hydraulic connections to provide the required power. These conventional connections are not shown and will not hereafter be discussed.

Dowel bar inserter kit E at crossbeam C and side bolsters or support beams S travels with paver P. Typical paving speeds can be as high as 15 feet (4.57M) per minute. In the usual case, a line of dowel bars is required about every 15 feet. Thus, there is a need to rapidly deliver dowel bars to the dowel bar inserters and effect the placement of the dowel bars to the middle of the recently placed slab.

Automated dowel bar insertion was pioneered by Ronald Guntert Sr, the deceased father of Ronald Guntert, the named inventor herein. It is instructive to understand both the geometry and operation of the dowel bar insertion.

Regarding the geometry of dowel bar inserter forks 32, such inserters are here shown mounted in arrays 34 of four sets of four inserter forks. Each array 34 attaches to inserter beam I at and through a vibration isolator (not shown). Further, each array 34 of four inserter forks each includes three electrically powered vibrators (also not shown). Naturally, the parameters of the dowel bar inserter array 34 can vary. Arrays having two or three forks and greater or lesser number of vibrators will work as well.

Figure 1B:
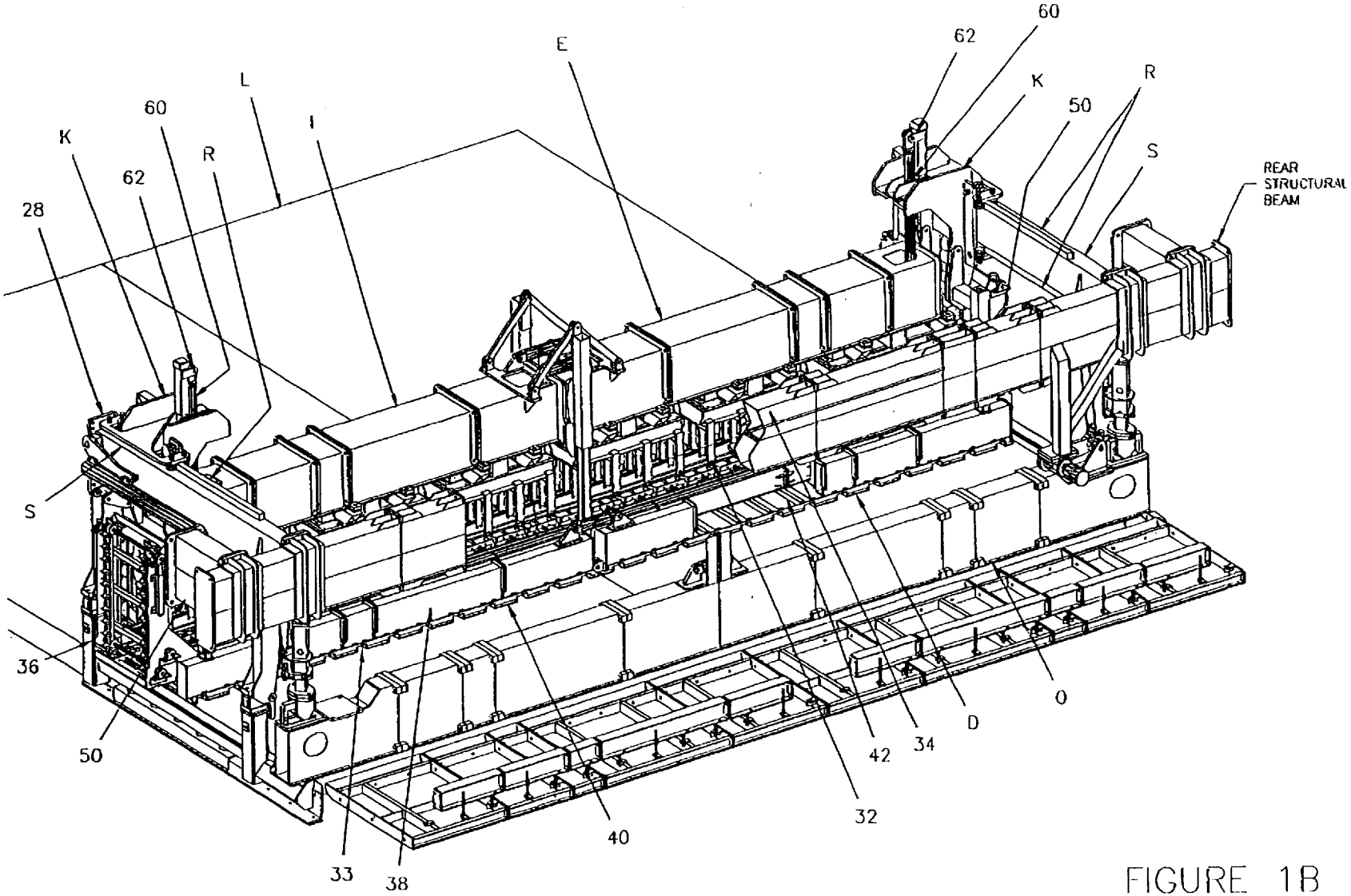
FIG. 1B is a partial perspective view of the dowel bar inserter kit showing the side bolsters, side lateral supporting beams, the supporting carriages, a structural cross-beam, the dowel bar inserter beam, dowel bar inserter fork assemblies , dowel bar inserter pan, an oscillating correcting beam, trailing sideforms and supports and the trailing finishing pan.
Figure 1C:
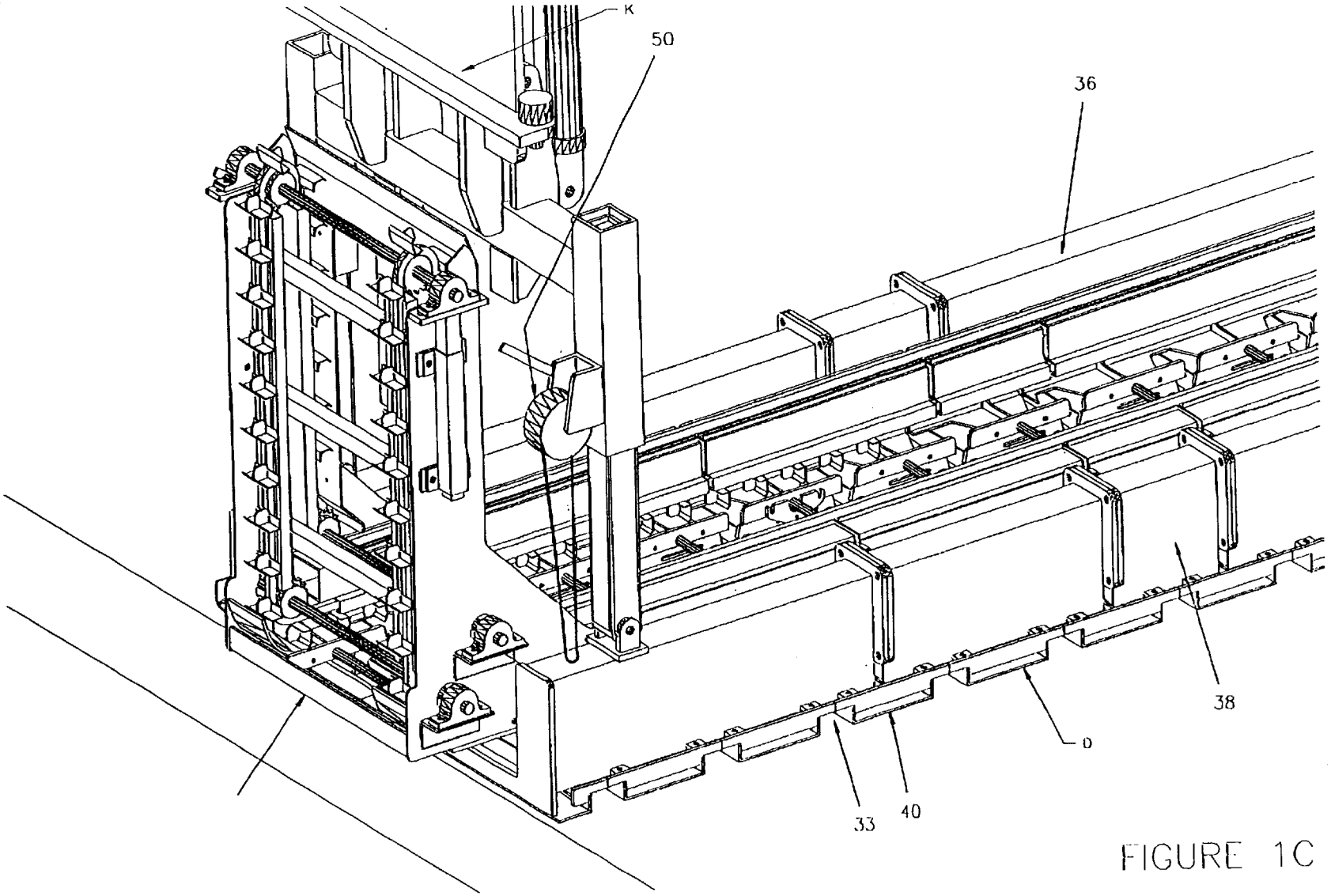
FIG. 1C is a partial perspective of the dowel bar inserter illustrating the chain feeder with vertical loading magazine where dowel bars are deposited being readied for registration for insertion into the plastic concrete slab.
Figure 2:
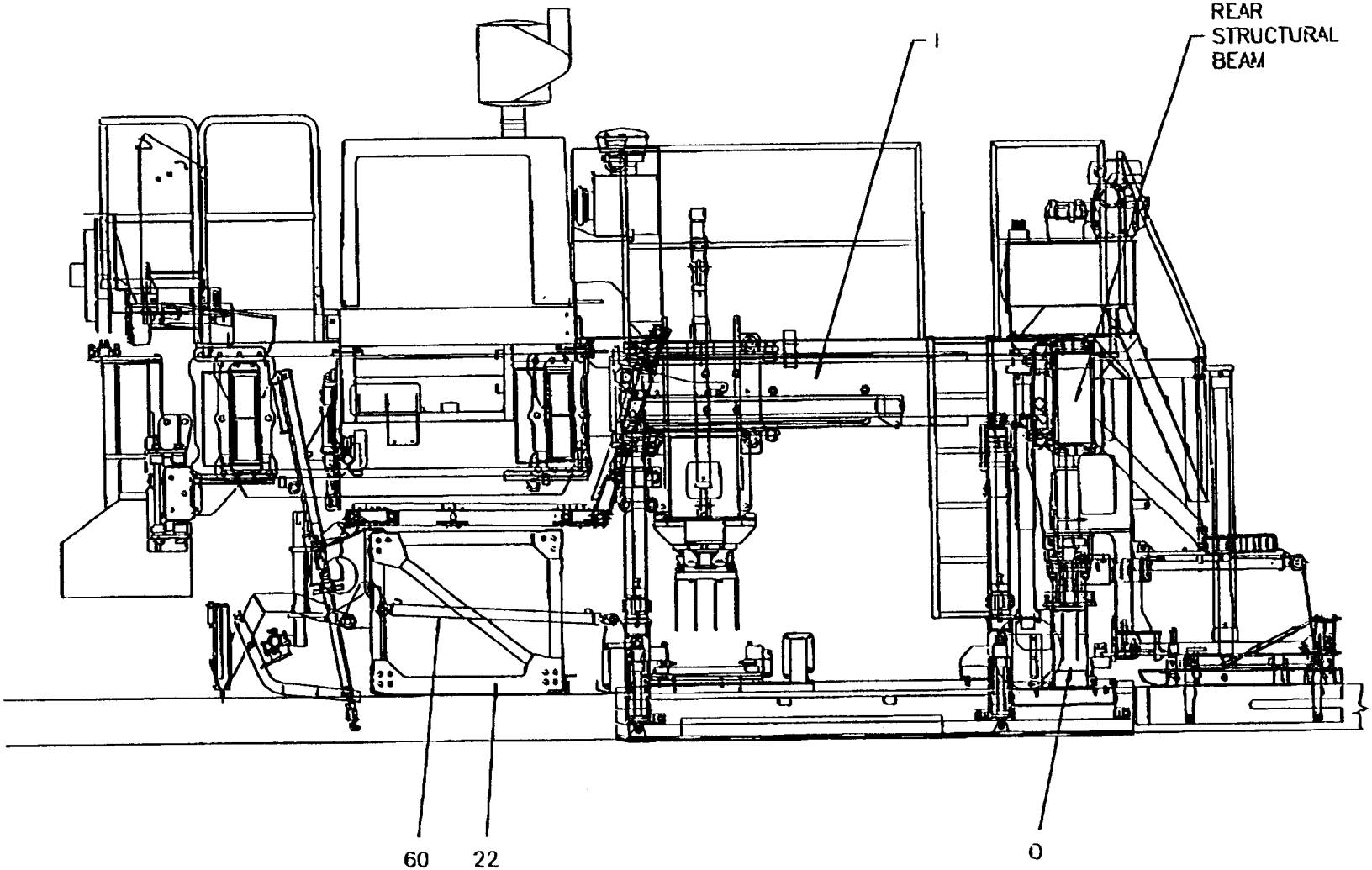
FIG. 2 is a cross-section taken along lines 2—2 of FIG. 1A illustrating the attached dowel bar inserter kit and paver, the rear support beam of the inserter kit attaches to the rear of the rear jacking columns of the slipform tractor frame.

Presuming that inserter beam I is stationary with respect to the recently formed plastic concrete slab L, insertion of the dowel bars can be conventionally described. FIG. 1B illustrates, dowel bar inserter pan D provided with continuous front member 36, raised rear member 38, and lane spacer members 40 there between. In between lane spacer members 40, there is provided dowel bar insertion apertures 33.

For the brief purpose of explaining the geometry of the dowel bar inserter forks 32, the reader is asked to consider the case where dowel bars are lying on the freshly formed concrete slab L immediately under dowel bar inserter forks 32 array 34. All that is required is that inserter beam I be lowered and array 34 of dowel bar inserter forks 32 be vibrated. When this occurs, dowel bars are inserted to the mid point of freshly formed slab L. The exact matter of placement of dowel bars to the slab L will later be made clear with respect to FIGS. 5A—5D.

Dowel bar insertion has an effect on the freshly slip formed slab L (See FIGS. 5A—5D). Simply stated both the added mass and confinement of the dowel bar inserter pan D and the vibration of dowel bar inserter forks 32 causes the surface of slab L to raise (or to be displaced) above that of the finished slab L. This displacement is apparent as the slab with the freshly inserted dowel bars comes from slipform 22 on paver P. Thus, raised rear member 38 of dowel bar inserter pan D enables this raised (or displaced) portion of the concrete to freely pass out through the back of the dowel bar inserter pan D. As will hereafter be pointed out, dowel bar inserter kit E includes oscillating correcting beam O. This oscillating correcting beam O causes the raised portion of slab L overlying each dowel bar to be re-finished even with the remainder of the slab L. Further, dowel bar inserter kit E is supplied with its own side forms. These side forms confine the plastic concrete slab at the edges during dowel bar insertion. For convenience of transport, the side forms remain connected to the dowel bar inserter kit E.

Second, however, it will be remembered that paver P and its attached dowel bar inserter kit E is continuously moving at a rate up to about 15 feet (4.57M) per minute placing slipformed slab L. Thus there is a need that during insertion that array 34 of dowel bar inserter forks 32 remain stationary with respect to the slipformed slab L as the dowel bar are inserted. Rails R on side bolsters or support beams S and cars K supporting inserter beam I at either end provide this function.

Side bolsters or support beams S are provided with rails R on lateral support beams. Cars or carriages K ride on rails R towards and away from paver P. When cars K move away from paver P, cars K may be held stationary with respect to recently slipformed slab L even though paver P proceeds continuously in the forward direction at a relative speed of up to 15 feet (4.57M) per minute.

It will be understood that the "down cycle" of array 34 of dowel bar inserter forks 32 is in the order of 7 seconds. Further, dwell time at the full depth of insertion is about 3 seconds. Finally the "up cycle" of the array 34 of dowel bar inserter forks 32 is about 5 seconds. Thus a total excursion of cars K on crawler tracks T of side bolsters or support beams S in the order of 3.75 feet is required when the paver P travels at about 15 feet (4.57 meters) per minute.

Figures 3A, 3B, 3C:
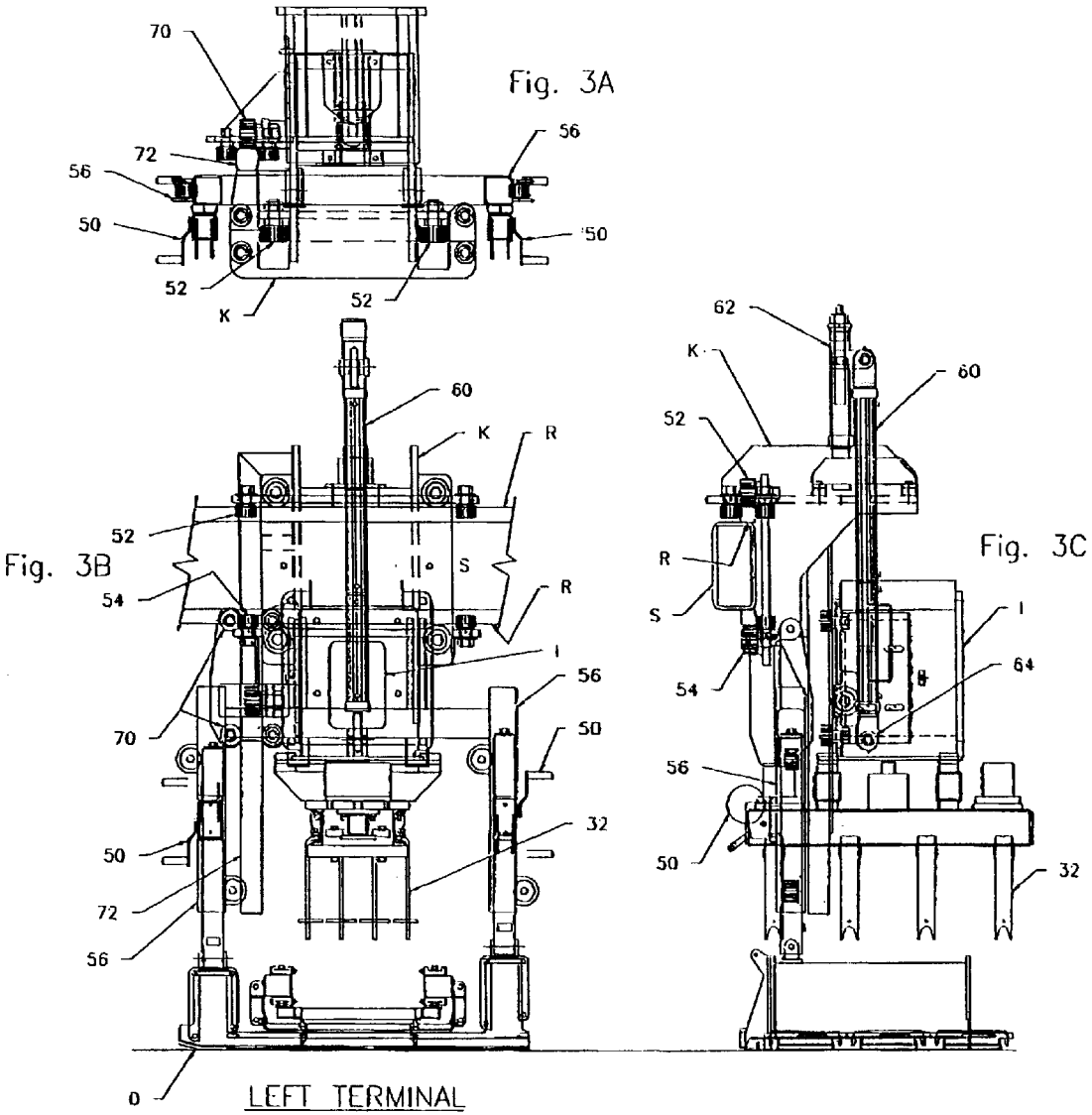
FIGS. 3A, 3B, and 3C are respective plan, side elevation, and end elevation views of the carriage on the left rear side of the machine as it proceeds in the forward direction.

Referring to FIGS. 3A—3C, carriage K on rails R on support beam S is shown. Upper roller array 52 captures rail R on top of support beam S. Lower roller array 54 captures rail R below support beam S. It will be understood that carriage K is free to ride rails R on support beam S towards and way from the direction of the paver kit travel.

It will be remembered that carriages K move simultaneously and have four discrete functions. The particular functions will each be described and those portions of the carriages K which perform those functions will be set forth. Some reference will have to be made with respect to FIGS. 5A—5D to set forth these functions.

First, carriage K support dowel bar inserter pan D through winches 50 and telescoping dowel bar inserter pan tubes 56.

Remembering that dowel bar inserter pan D in effect "floats" on the surface of slab L, it will be understood that winches 50 can be provided with separate and individual adjustment to obtain optimum response relative to bouyant forces reacting from slab L.

Second, carriages K on rails R of support beam S support inserter beam I. Such support is provided by inserter beam cylinders 60 fastening at height adjustment 62 on top of carriage K at one end and inserter beam I at clevis 64 at the lower end. With the illustrated arrangement, movement of inserter beam I does not appreciably change the force on dowel bar inserter pan D.

Third, carriage K must center dowel bar inserter pan D with respect to dowel bar inserters 32. This occurs through two interactions. First, roller group 70 rides on square vertical rider tube 72. Secondly, inserter beam I is pendulously supported from the respective carriages K.

It will be remembered that inserter beam I "crowns", creating a change in the length of this beam between roller groups 70 at the respective ends of the beam. In actual fact, roller groups 70 pin to the carriages at inserter beam pivots 74.

Finally, it is required that carriages K provide alignment to dowel bar inserter pan D. It will be seen that telescoping dowel bar inserter pan tubes 56 (also provided with roller groups) effect such centering of the dowel bar inserter pan D adjacent carriages K.

It is also necessary that centering be provided between inserter beam I and dowel bar inserter pan D. This is provided first by the suspension of dowel bar inserter pan D as illustrated in FIG. 6 and second by the centering tube arrangement shown in FIG. 4A—4C.

Figure 5A:
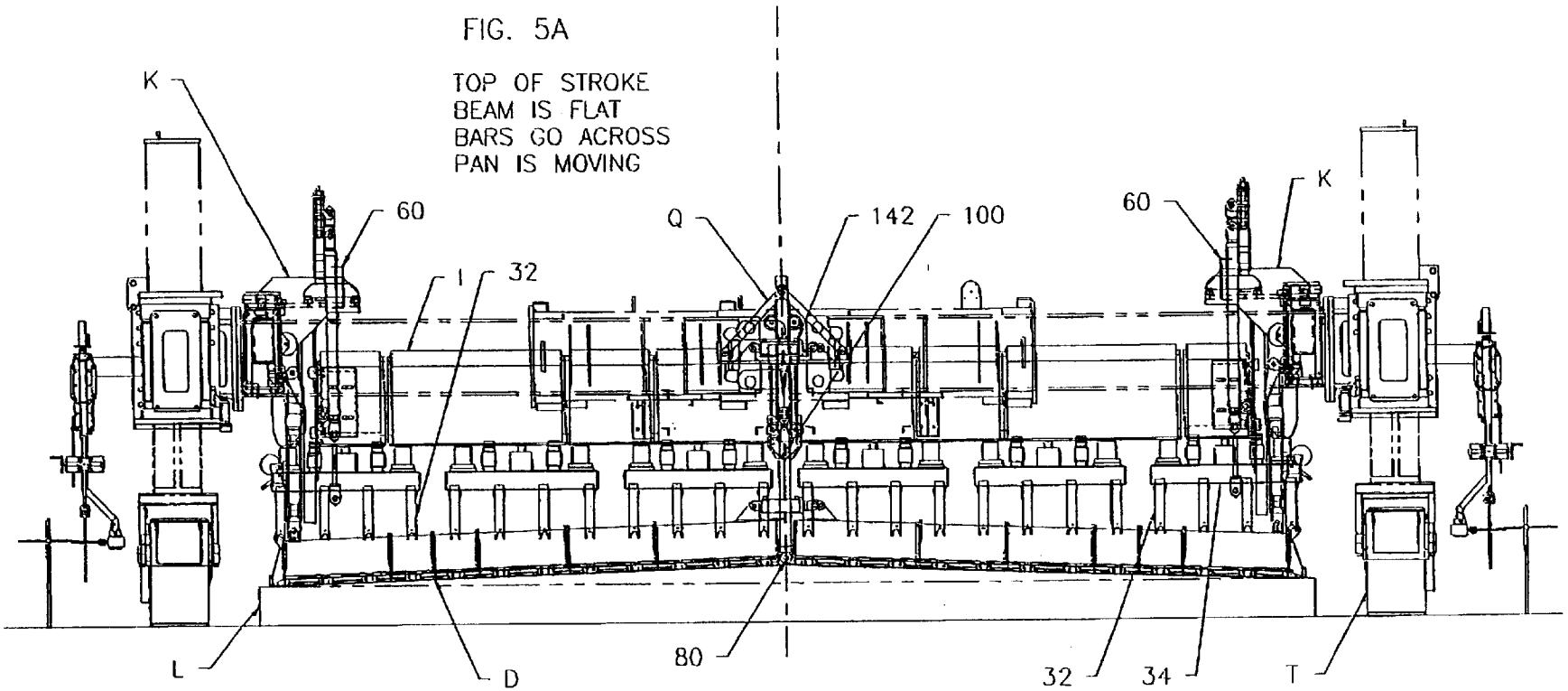
FIG. 5A–FIG. 5D are a cartoon series of dowel bar insertion where
Figure 5B:
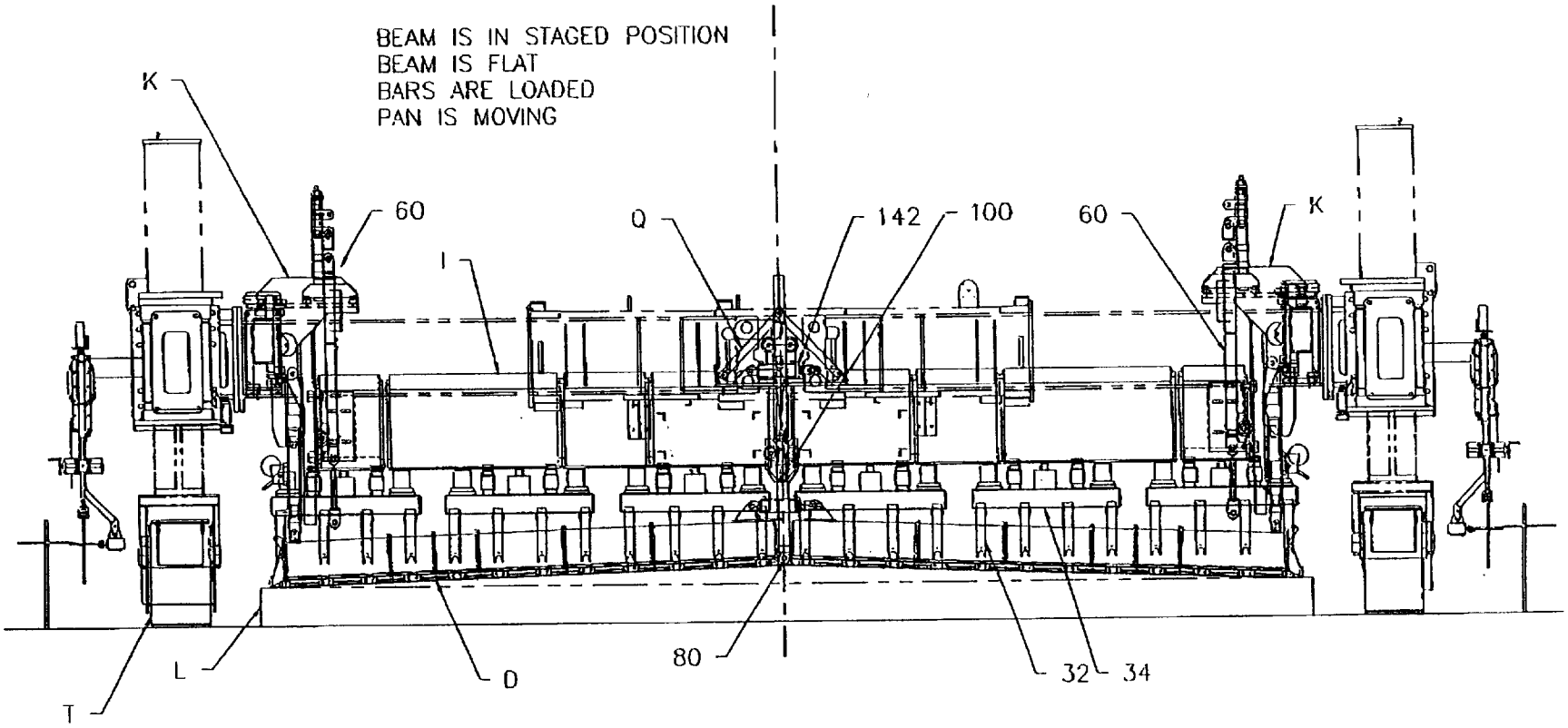
Figure 5C:
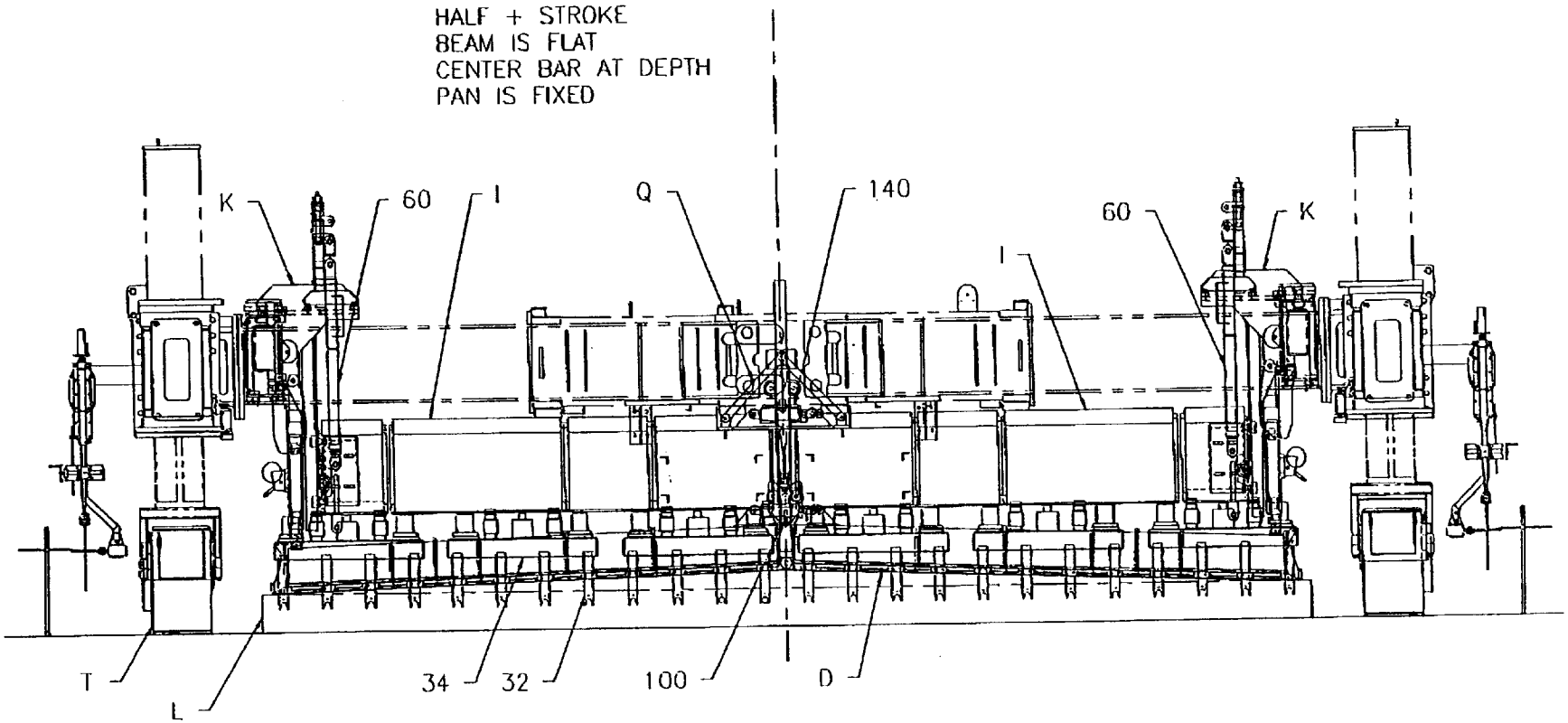
Figure 5D:
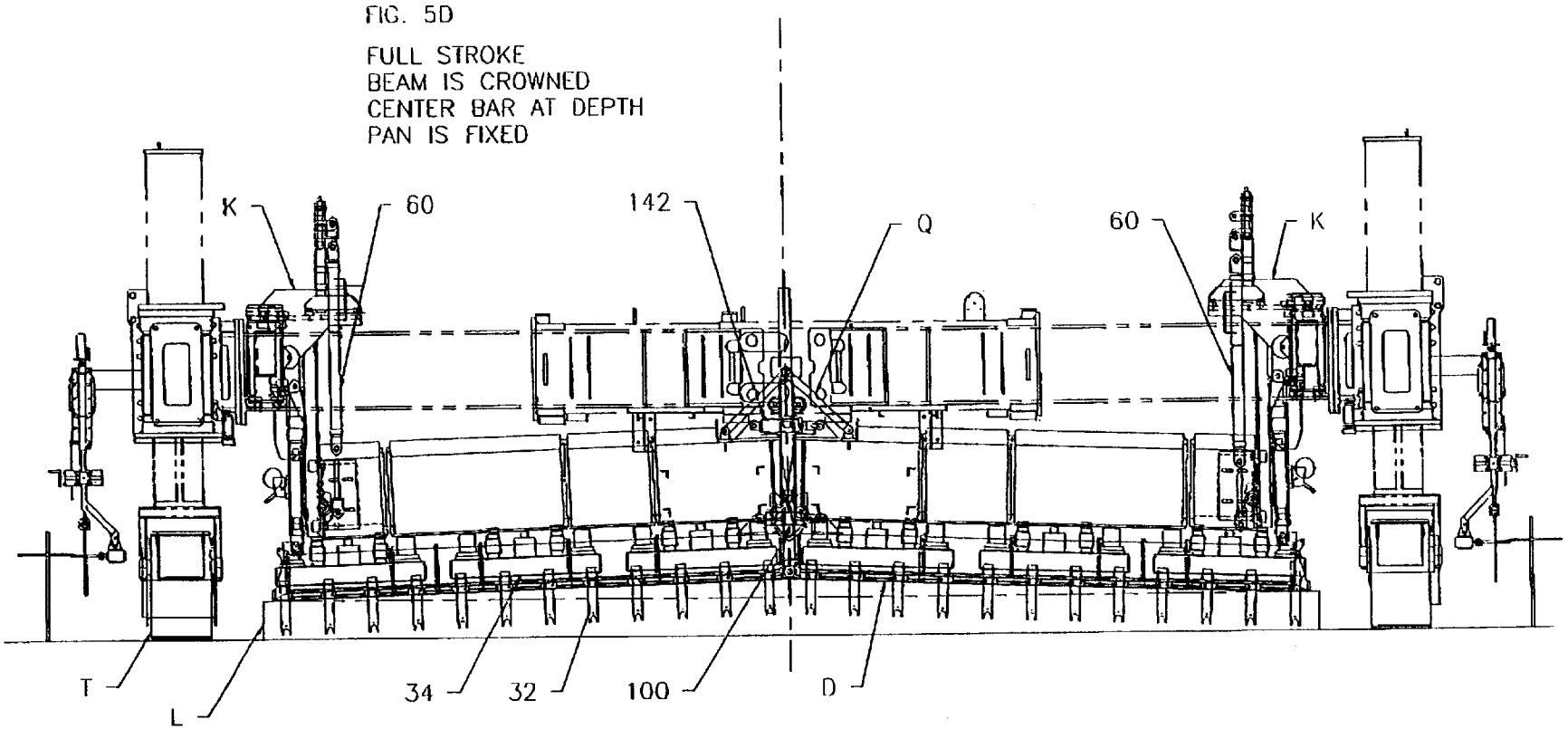
Figure 6:
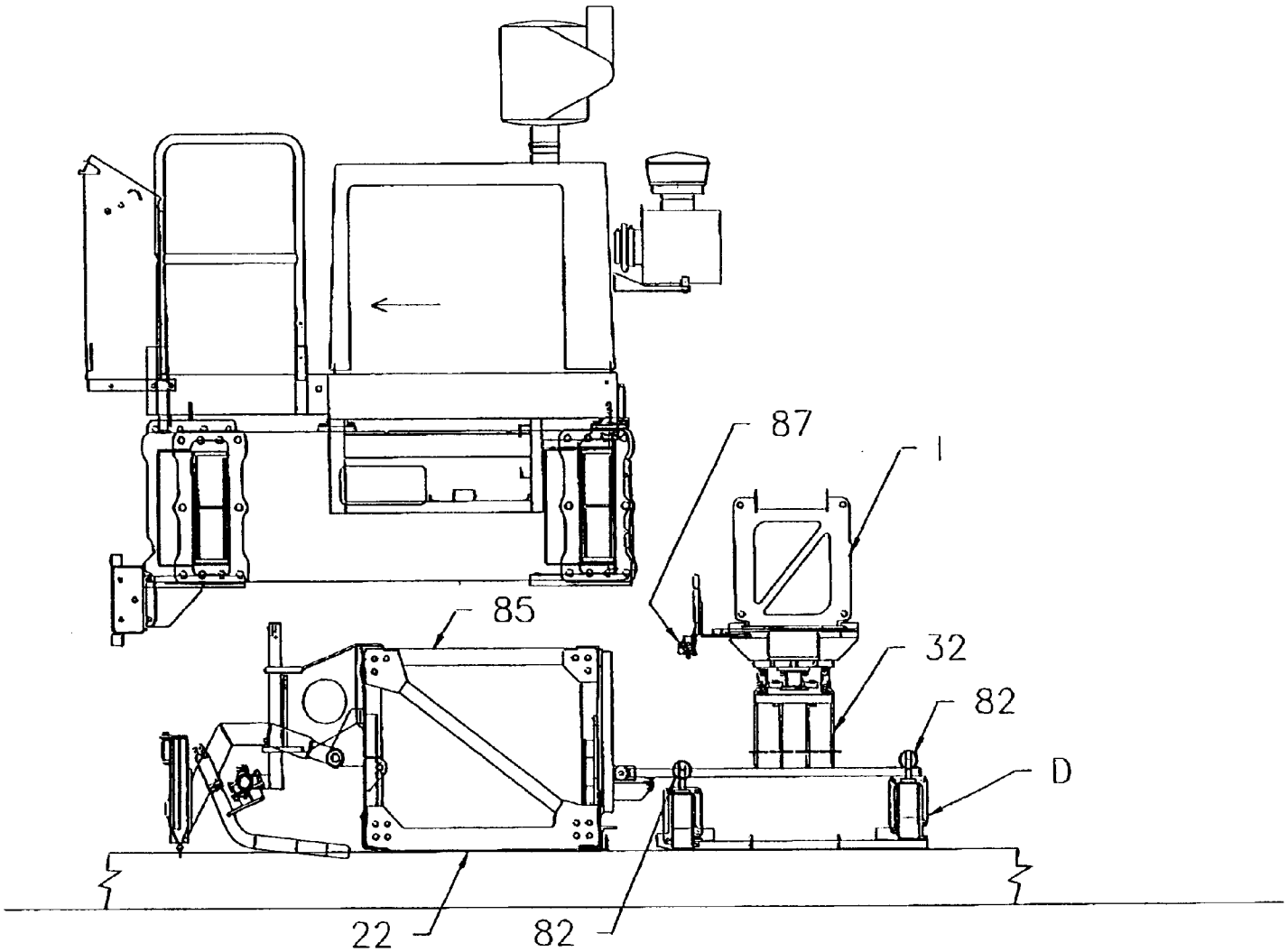

Referring briefly to FIG. 6, (and respective FIGS. 5A—5D, it will be seen that dowel bar inserter pan D has medial dowel bar inserter pan hinge 80. Overlying medial dowel bar inserter pan hinge 80 are dowel bar pan cylinders 82. When dowel bar pan cylinders 82 expand, dowel bar inserter pan D crowns about medial dowel bar inserter pan hinge 80.

It will be remember that dowel bar inserter pan D is essentially supported at each end at carriages K. Such support comes from winches 50, and the buoyant force produce by dowel bar inserter pan D as it passes over slab L. Where the previously laid slab L is provided with a crown, and dowel bar pan cylinders 82 are expanded, dowel bar inserter pan D will match the crown already imparted to slab L.

Referring to FIG. 6, it will be seen that pan 85 under paver P can provide a convenient reference. Specifically, a roto-valve sensor 87 takes reference from the height of pan 85. This sensor provides hydraulic fluid to dowel bar pan cylinders 82. These cylinders in turn cause dowel bar inserter pan D to crown. It will be understood that this crowning is assisted by the buoyant force acting on dowel bar inserter pan D. By setting the neutral position on roto-valve sensor 87, the force by which dowel bar inserter pan D bears on the crown of slab L is adjustable.

Figures 4A, 4B, 4C:
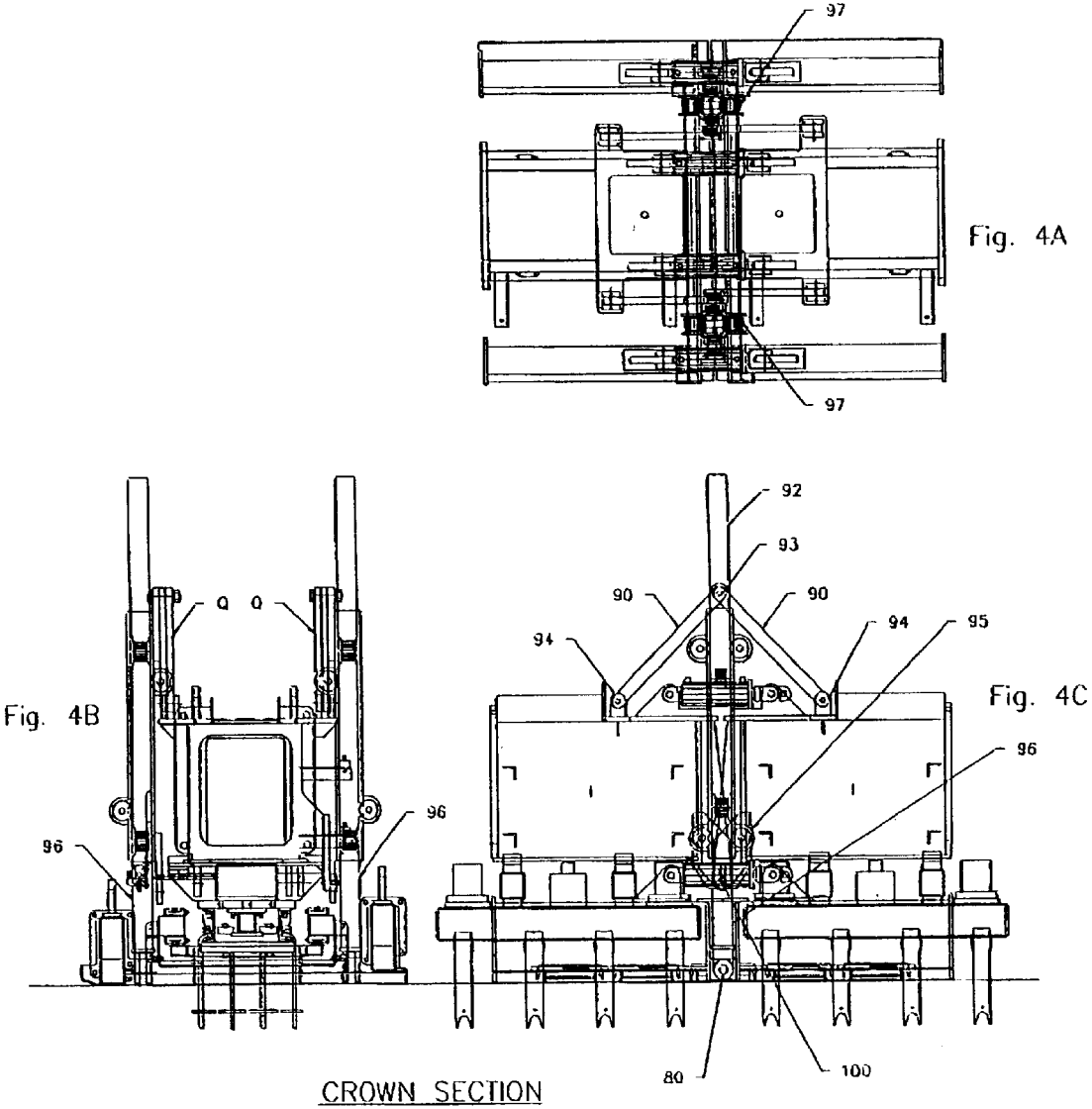
FIGS. 4A, 4B and 4C are respective plan, side elevation, and end elevation views of the central vertical telescoping tubes between the lower central portion of the dowel bar inserter pan and the insertion beam.

It is also necessary to have inserter beam I centered with respect to dowel bar inserter pan D centrally of both dowel bar inserter pan D and inserter beam I. This centering must occur without force being appreciably varied on dowel bar inserter pan D. The structure through which this is done is shown in FIG. 4A–4C. Inserter beam I is provided with dynamic A-frame Q. The action of this dynamic A-frame Q can be best seen in FIG. 4C.

A-frame links 90 pin to central inserter beam vertical tube 92 at upper pin 93 and spaced apart pin positions 94 on inserter beam I. Central inserter beam vertical tube 92 mates with central dowel bar inserter pan vertical tube 96, which is pinned at medial dowel bar inserter pan hinge 80. At the same time, central inserter beam vertical tube 92 passes through roller assembly 97. Given the relationship of dynamic A-frame Q and roller assembly 97, it will be seen that central inserter beam vertical tube 92 effectively bisects the angle between each half of inserter beam I. As a result, central inserter beam vertical tube 92 will remain essentially vertical.

Mating central dowel bar inserter pan vertical tube 96 is pined at dowel bar inserter pan D at medial dowel bar inserter pan hinge 80. This central dowel bar inserter pan vertical tube 96 fits into and is received in mating relation by central inserter beam vertical tube 92. As a result, the respective central inserter beam vertical tube 92 and central dowel bar inserter pan vertical tube 96 move in sliding vertical relationship one to another. To assure that this mating is relatively frictionless, roller assemblies 97 are utilized. As a result, centering between inserter beam I and dowel bar inserter pan D. This assures that dowel bar inserters 32 pass through dowel bar insertion apertures 42 in dowel bar inserter pan D.

We show the dowel bar inserter kit 32 attached to paver P. Those having skill in the art will understand that this unit could as well be mounted to its own propelling tractor.

Having set forth the structure, the operational sequence of the inserter beam I and its attached arrays of dowel bar inserter assemblies 34 can be understood.

Initially, and as shown in FIG. 4A, inserter beam I is horizontally disposed. When horizontally disposed, inserter beam I has its respective dowel bar inserter kit T with their respective dowel bar inserter assembly arrays 34 with inserter forks 32 aligned parallel to dowel bar insertion apertures 42 in dowel bar inserter pan D. As a consequence, when inserter beam I is lowered to and toward slip form paving kit 22, dowel bar inserters 32 pass through dowel bar insertion apertures 42 without interference.

Referring to FIGS. 5B and 5C, inserter beam I is shown lowered to dowel bar inserter pan D at central hinge 80. It will be understood that the central portion of inserter beam I can not be lowered further without interference from dowel bar inserter pan D in the vicinity of central hinge 80.

Finally, and referring to FIGS. 5D, it will be seen that inserter beam I is hinged about central support beam hinge 100. This hinging action is brought about by expansion of crown cylinders 142. This causes each of the respective ends of inserter beam I on either side of central support beam hinge 126 to be disposed parallel to the respective corresponding sides of dowel bar inserter pan D relative to slip form hinge 122. All dowel bar inserters 32 from dowel bar inserter kits I will dispose respective dowel bars urged by the inserters into the freshly formed slab L to the same depth relative to the top surface of slab L.

In the case of the illustrated insertion, the reader will understand that retraction of dowel bar inserters 32 must occur. This retraction occurs by having the opposite sequence occur with retraction starting from the illustrated position in FIG. 5D, and then to 5C, 5B and finally ending as illustrated in FIG. 5A. Thus the full cycle of the apparatus of this invention can be understood.

What is claimed is:

1. A dowel bar inserter kit for use in combination with a paver wherein the paver includes:

a propelling apparatus for moving along a paving path;

a supported frame from the propelling apparatus;

a paving kit for imparting shape to a plastic concrete slab from freshly placed concrete placed in the path of the paver;

the dowel bar inserter kit comprising:

at least two laterally extending support beams supported from the supported frame at one end and extending away from and behind the supported frame;

a plurality of support carriages, each support carriage for moving synchronously on each laterally extending support beam for moving towards and away from the supported frame of the paver;

a suspended dowel bar inserter pan attached at distal ends to the support carriages, the suspended dowel bar inserter pan defining apertures for insertion of dowel bars through the suspended dowel bar inserter pan and having a medial dowel bar inserter pan hinge to enable the suspended dowel bar inserter pan to crown;

an inserter beam supported at distal ends to the support carriages, the inserter beam having dowel bar inserters corresponding to the apertures for the insertion of dowel bars through the suspended dowel bar inserter pan and having a medial inserter beam hinge to enable the suspended dowel bar inserter beam to crown with respect to a corresponding crown in the suspended dowel bar inserter pan;

apparatus for moving the inserter beam towards and away from the dowel bar inserter pan extending between each carriage and a distal end of the inserter beam;

first centering apparatus attached between the insertion beam and the dowel bar insertion pan for registering the dowel bar inserters with respect to the dowel bar apertures;

a second centering apparatus attached between the dowel bar inserter pan and the carriages for centering the dowel bar inserter pan with respect to the carriages; and, apparatus for moving the dowel bar inserter pan, inserter beam and carriages towards and away from the paver.

2. The dowel bar inserter kit according to claim 1 and comprising in further combination:

a support beam extending between the two laterally extending support beams to enable removal of the dowel bar inserter kit as a unit.

3. The dowel bar inserter kit according to claim 1 and comprising in further combination:

the suspended dowel bar inserter pan attached at distal ends to the support carriages includes telescoping tubes and hand winches to enable the buoyant force of the dowel bar inserter pan together with its alignment to and suspension from the paver to be adjustably maintained.

4. The dowel bar inserter according to claim 1 and comprising in further combination:

the inserter beam supported at distal ends to the support carriages adjustably suspend an inserter beam with respect to the paver to allow a plurality of dowel bar inserter fork assemblies suspended from the support beam to place dowel bars into a continuous slab without changing force on the buoyantly supported dowel bar inserter pan.

5. The dowel bar inserter according to claim 1 and comprising in further combination:

the carriages provide vertical members with respect to the frame of the paver which enable side to side, fore and aft, and vertical reference of the support beam with respect to the paver frame during up and down inserting movement.

6. The dowel bar inserter according to claim 1 and comprising in further combination:

the carriages enable side to side, and fore and aft centering of the dowel bar inserter pan at their edges adjacent the carriages.

7. In the combination of a paver and a dowel bar inserter kit together comprising:

a propelling apparatus for moving the dowel bar inserter kit along a paving path;

a supported frame from the propelling apparatus extending parallel to the paving path;

a support beam attached from the supported frame extending across the paving path, the support beam having a medial support beam hinge;

a dowel bar inserter kit including a plurality of dowel bar inserters suspended from the support beam for placing dowel bars into a freshly placed plastic concrete slab;

a dowel bar inserter pan attached to the support beam for passing over the freshly placed plastic concrete slab on the paving path, the dowel bar inserter pan defining apertures for insertion of dowel bars through the suspended dowel bar inserter pan and having a medial dowel bar inserter pan hinge to enable the suspended dowel bar inserter pan to crown both with respect to the freshly placed plastic concrete slab and the support beam;

an alignment apparatus from the support beam to enable the insertion of dowel bars through the dowel bar inserter pan, the alignment apparatus comprising:

a first vertical alignment beam attached to the support beam at the support beam hinge;

a second vertical alignment beam attached to the dowel bar inserter pan at the medial dowel bar inserter pan hinge;

means for linking the support beam and the dowel bar inserter pan on opposite sides of the medial support beam hinge to maintain the second vertical alignment beam at a bisected angular relationship relative to opposite sides of the support beam at the medial support beam hinge; and, means for permitting parallel sliding engagement between the first vertical alignment beam and the second vertical alignment beam whereby when the dowel bar inserters move towards and away from the suspended dowel bar inserter pan, the dowel bar inserter pan is maintained in alignment with respect to the dowel bar inserters.

8. The combination according to claim 7 further including:

the dowel bar inserters are supported from the support beam; and, the support beam moves towards and away from the suspended dowel bar inserter pan during dowel bar insertion.

9. A process of inserting dowel bars into a freshly placed plastic concrete slab having an elevated crown in a center of the freshly placed plastic concrete slab with two sloping sides of the freshly placed plastic concrete pan on either side of the crown, the process of insertion comprising the steps of:

providing a supported frame extending parallel to the paving path;

providing a propelling apparatus for moving the support frame along the freshly placed plastic concrete path;

providing laterally extending support beams extending from the supported frame for extension parallel to and over the freshly placed concrete slab;

providing a carriage on each laterally extending support beam for simultaneous movement with at least one other carriage on one other support beam;

providing an insertion beam extending across the paving path, the insertion beam having a medial support beam hinge to enable the support beam to crown with respect to the crown of the freshly placed plastic concrete slab;

providing a plurality of dowel bar inserters suspended from the support beam for placing dowel bars into the freshly placed plastic concrete slab;

providing a suspended dowel bar inserter pan attached to the carriages for passing over the freshly placed plastic concrete slab on the paving path, the dowel bar inserter pan defining apertures for insertion of dowel bars through the dowel bar inserter pan and having a medial dowel bar inserter pan hinge to enable the suspended dowel bar inserter pan to crown with respect to the freshly placed plastic concrete slab;

flexing the dowel bar inserter pan at the medial dowel bar inserter pan hinge to conform the dowel bar inserter pan to the freshly placed plastic concrete pan having a crown;

moving the insertion beam to a horizontal disposition to align the dowel bar inserters with the apertures for insertion of dowel bar through the dowel bar inserter pan;

while the dowel bar inserters are in the horizontal disposition, moving the support beam and the dowel bar inserters toward the suspended slip form to enable dowel bar inserters to penetrate apertures in the dowel bar inserter pan for the insertion of dowel bars;

moving at least some of the dowel bar inserters overlying a center of the dowel bar inserter pan through the dowel bar inserter pan at the apertures;

after the moving at least some of the dowel bar inserters overlying a center of the dowel bar inserter pan through the dowel bar inserter pan, then crowning the dowel bar inserters around the medial support beam hinge to have the dowel bar inserters on either side of the medial support beam hinge parallel to and equidistant from the suspended dowel bar inserter pan on either side of the medial slip form hinge;

inserting dowel bars using the dowel bar inserters.

10. The process of inserting dowel bars into a freshly placed plastic concrete slab according to claim 9 and having the additional steps of:

providing a support beam extending between the two laterally extending support beams and part of the supported frame; and, attaching the dowel bar inserter kit as a unit to a paver.

11. The process of inserting dowel bars into a freshly placed plastic concrete slab according to claim 9 and having the additional steps of:

providing a suspended dowel bar inserter pan attached to the carriages includes providing telescoping tubes and hand winches;

adjusting the hand winches to enable the buoyant force of the dowel bar inserter pan together with its alignment to and suspension from the paver to be adjustably maintained.

12. The process of inserting dowel bars into a freshly placed plastic concrete slab according to claim 9 and having the additional steps of:

supporting the inserter beam at distal ends to the support carriages to adjustably suspend an inserter beam with respect to the paver to allow a plurality of dowel bar inserter fork assemblies suspended from the support beam to place dowel bars into a continuous slab without changing force on the buoyantly supported dowel bar inserter pan.

13. The process of inserting dowel bars into a freshly placed plastic concrete slab according to claim 9 and having the additional steps of:

providing vertical members on the carriages with respect to the frame which enable side to side, fore and aft, and vertical reference of the support beam with respect to the paver frame during up and down inserting movement.

14. The process of inserting dowel bars into a freshly placed plastic concrete slab according to claim 9 and having the additional steps of:

centering the dowel bar inserter pan at its edges adjacent the carriages to enable side to side, and fore and aft alignment of the dowel bar inserter pan.

* * * * *

UNITED STATES PATENT AND TRADEMARK OFFICE

CERTIFICATE OF CORRECTION

PATENT NO. : 6,390,727 B1
DATED : May 21, 2002
INVENTOR(S) : Guntert, Jr. et al.

It is certified that error appears in the above-identified patent and that said Letters Patent is hereby corrected as shown below:

Title page,
Item [56], References Cited,

U.S. PATENT DOCUMENTS

| | | | |
|---|---|---|---|
| 4493584 | Jan., 1985 | Guntert. | |
| 5135333 | Aug., 1992 | Guntert, Sr. et al. | |
| 5190397 | Mar., 1993 | Bengford et al. | |
| 5209602 | May., 1993 | Godbersen. | |
| 5318377 | Jun., 1994 | Swisher, Jr. et al. | 404/74. |
| 5405212 | Apr., 1995 | Swisher, Jr. et al. | |
| 5588776 | Dec., 1996 | Swisher, Jr. et al. | 404/72. |
| 5590977 | Jan., 1997 | Guntert et al. | 404/101. |
| 5615972 | Apr., 1997 | Guntert et al. | |
| 5647688 | Jul., 1997 | Guntert et al. | |
| 5924817 | Jul., 1999 | Godbersen | |

Signed and Sealed this

Sixth Day of May, 2003

JAMES E. ROGAN
*Director of the United States Patent and Trademark Office*